US007192912B2

(12) United States Patent
Laux

(10) Patent No.: US 7,192,912 B2
(45) Date of Patent: Mar. 20, 2007

(54) NO VOC SOLVENT BLEND

(75) Inventor: Benjamin Laux, Monroe, OH (US)

(73) Assignee: JohnsonDiversey, Inc., Sturtevant, WI (US)

( * ) Notice: Subject to any disclaimer, the term of this patent is extended or adjusted under 35 U.S.C. 154(b) by 86 days.

(21) Appl. No.: 10/803,859

(22) Filed: Mar. 18, 2004

(65) Prior Publication Data

US 2005/0209123 A1 Sep. 22, 2005

(51) Int. Cl.
*C11D 17/00* (2006.01)

(52) U.S. Cl. ..... 510/405; 510/407; 510/505; 510/506; 510/365; 134/26; 134/30; 134/40

(58) Field of Classification Search ..... 510/405, 510/407, 505, 506, 365; 134/26, 30, 40
See application file for complete search history.

(56) References Cited

U.S. PATENT DOCUMENTS

| | | | | |
|---|---|---|---|---|
| 4,257,909 | A | 3/1981 | Christianson | 252/170 |
| 4,780,235 | A | 10/1988 | Jackson | 252/170 |
| 5,062,988 | A | 11/1991 | Dishart et al. | 252/170 |
| 5,158,706 | A | 10/1992 | Mancini | 252/364 |
| 5,370,817 | A | 12/1994 | Weltman et al. | 252/170 |
| 5,372,742 | A | 12/1994 | Bayless | 252/170 |
| 5,437,808 | A | 8/1995 | Weltman et al. | 510/407 |
| 5,567,348 | A | 10/1996 | Nozawa et al. | 510/175 |
| 5,604,196 | A | 2/1997 | Weltman et al. | 510/407 |
| 5,612,303 | A | 3/1997 | Takayanagi et al. | 510/174 |
| 5,654,268 | A | 8/1997 | Norcia | 510/134 |
| 5,728,662 | A * | 3/1998 | Vlasblom | 510/130 |
| 5,780,407 | A | 7/1998 | Van Slyke | 510/188 |
| 5,811,383 | A * | 9/1998 | Klier et al. | 510/417 |
| 5,863,881 | A | 1/1999 | Vlasblom | 510/365 |
| 5,877,133 | A * | 3/1999 | Good | 510/175 |
| 5,916,857 | A | 6/1999 | Watson et al. | 510/174 |
| 5,952,287 | A | 9/1999 | Gross et al. | 510/417 |
| 5,972,874 | A | 10/1999 | Libutti et al. | 510/417 |
| 5,985,816 | A | 11/1999 | Vlasblom | 510/365 |
| 5,990,072 | A | 11/1999 | Gross et al. | 510/417 |
| 5,998,352 | A | 12/1999 | Vlasblom | 510/365 |
| 6,090,765 | A | 7/2000 | Black et al. | 510/238 |
| 6,090,769 | A | 7/2000 | Vlasblom | 510/365 |
| 6,165,962 | A | 12/2000 | Kaler et al. | 510/365 |
| 6,224,685 | B1 | 5/2001 | Gross et al. | 134/38 |
| 6,235,698 | B1 | 5/2001 | Vlasblom | 510/365 |
| 6,306,943 | B1 | 10/2001 | Henry | 524/270 |
| 6,310,263 | B1 | 10/2001 | Vlasblom | 585/1 |
| 6,369,016 | B1 | 4/2002 | Vlasblom | 510/365 |
| 6,583,097 | B2 * | 6/2003 | McDonald | 510/365 |
| 6,613,158 | B2 | 9/2003 | Gross et al. | 134/40 |
| 2003/0171242 | A1 * | 9/2003 | Michaud et al. | 510/417 |

FOREIGN PATENT DOCUMENTS

| | | | |
|---|---|---|---|
| WO | WO95/09204 | * | 4/1995 |

OTHER PUBLICATIONS

Hawley's Condensed Chemical Dictionary, Eleventh Edition, 1987, p. 892 describes defintion of petroleum.*
Lyondell Solvent Properties Chart , 2005.*
Pearl Paints North America, Inc. , Solvents, 2006.*
Certified English Translation of WO95/09204.*

* cited by examiner

*Primary Examiner*—Sharidan Carrillo
(74) *Attorney, Agent, or Firm*—Wood, Herron & Evans, L.L.P.

(57) ABSTRACT

A solvent blend effective to remove grease and oil includes a hydro treated light petroleum distillate in combination with a glycol ether and an ester solvent. Each of the components has a vapor pressure of less than 0.1 mm Hg at 20° C. and accordingly contained no volatile organic compounds. These effectively remove grease and oil and can be emulsified into water to form an aqueous cleaning composition.

6 Claims, No Drawings

NO VOC SOLVENT BLEND

BACKGROUND OF THE INVENTION

Due to government regulations and environmental concerns, the use of volatile organic compounds must be reduced. It is desirable to provide cleaning agents that do not contain volatile organic compounds. A volatile organic compound is defined as one which has a vapor pressure equal to or greater than 0.1 mm Hg at 20° C.

It is, however, very difficult to provide an effective cleaning solvent that contains no volatile organic compounds.

SUMMARY OF THE INVENTION

The present invention is premised on the realization that a solvent blend which effectively dissolves grease and oil includes a major portion of a petroleum distillate having a vapor pressure less than 0.1 mm Hg in combination with a glycol ether soluble in the petroleum distillate and also having a vapor pressure of less than 0.1 mm Hg combined with a third component. The third component is a low molecular weight ester, soluble at room temperature and likewise having a vapor pressure of less than 0.1 mm Hg.

More particularly, the present invention is premised on the realization that a solvent blend having a combination of 30% to 60% by weight of light petroleum distillate, preferably hydrotreated light petroleum distillate, in combination with 20% to 50% by weight of a glycol ether and at least 10% of a $C_1$–$C_4$ ester having a chain length of less than 15 and a vapor pressure of less than 0.1 mm Hg effectively dissolves grease and oil.

The object and advantages of the present invention will be further appreciated in light of the following detailed description.

DETAILED DESCRIPTION OF THE INVENTION

The present invention is a blend of three separate solvents which effectively remove grease and oil, and which has no volatile organic compounds. The composition includes a petroleum distillate, a glycol ether and a ester solvent.

The composition will include 30–60% by weight of a petroleum distillate. In particular, the petroleum distillate should be a light petroleum distillate and, more particularly, a hydro treated petroleum distillate.

Hydrotreated light petroleum distillates have a carbon number ranging from 9 to 16 and a boiling temperature range from 150° to 290° C. The hydro treatment simply saturates the olefin by adding hydrogen. One preferred hydrotreated light petroleum distillate is sold by Exxon under the name Exxsol D-110 which has a vapor pressure of less than 0.1 mm Hg at 20° C. Other similar light petroleum distillates having a vapor pressure less than 0.1 mm Hg will also function in the present invention.

The second component of the present invention is a glycol ether solvent, again having a vapor pressure of less than 0.1 mm Hg at 20° C. There are a wide range of commercially available glycol ethers. Specific examples include propylene glycol n-butyl ether, propylene glycol n-propyl ether, diethylene glycol monobutyl ether, ethylene glycol monobutyl ether, dipropylene glycol methyl ether, tripropylene glycol methyl ether, dipropylene glycol n-propyl ether, dipropylene glycol mono n-butyl ether, tripropylene glycol mono n-butyl ether, propylene glycolphenyl ether and propylene glycol n-butyl ether.

Preferred glycol ethers include dipropylene glycol n-butyl ether (Dowenol DpNB), tripropylene glycol n-butyl ether (Dowenol TpNB), tripropylene glycol methyl ether (Dowenol TPM), and propylene glycol phenyl ether (Dowenol PPh). As indicated, these can be used in an amount from 20 to 50% by weight of the solvent blend with about 30% being preferred.

The third component of the solvent blend of the present invention will be at least 10% of an ester solvent. The ester solvent will have a vapor pressure less than 0.1 mm Hg at 20° C. Generally, these will be a $C_1$–$C_4$ alkyl ester or diester having a fatty acid carbon chain length of less than about 18. Blends of these esters can also be employed.

Suitable esters include methyl laurate, methyl myristate, methyl palmitate, 2-ethyl hexylactate, diisobutyl gluterate, diisobutyl adipate, diisobutyl succinate, dimethyl adipate, dimethyl gluterate, and dimethyl succinate.

Commercially available blends of ester solvents include Edenor C1270 from Cognis, which includes a combination of primarily methyl laurate and methyl myristate and a small portion of methyl palmitate; PuraSolv EHL from Purac; DBE-IB from DuPont, which is a combination of diisobutyl esters of gluteric acid, adipic acid and succinic acid; DBE-3, which is a dimethyl ester of adipic acid in combination with gluteric acid; and finally DBE-5, which is 99% dimethyl gluterate with the remainder dimethyl succinate. As the ester solvent is generally the most expensive component of the present invention, its use is minimized. Therefore, the present invention should have at least 10% by weight of the ester solvent up to about 30%, again with 10% being preferred.

The solvent formulation of the present invention is formed by simply blending the individual components. No order of addition is required. Further, blending can be conducted at room temperature.

This solvent can be used to clean or remove hydrocarbon type soils, oils and greases from hard surfaces. It can also be used for degreasing parts and can be incorporated into aqueous cleaning solutions for floor scrubbing, spray and wipe, and pressure washing. If added to water, the concentration of the solvent blend should be 1 to 20% by weight.

The present invention will be further appreciated in light of the following detailed example.

EXAMPLE 1

A no VOC solvent blend was formed by combining 10% Edenor ME C1270 (ester solvent), 30% Dowenol DpNB (glycol ether), and 60% Exxsol D-110. This was compared under identical circumstances with d-limonene, butyl cellosolve, Edenor ME C1270 by itself, DuPont DBE-IB by itself, PuraSolv EHL by itself, Dowenol DpNB by itself, and Exxsol D-110 by itself.

To test the solvents and cleaning solutions, grease was placed on a test strip and weighed. The test strip was placed in the solvent or cleaning solution for 5 minutes, removed, rinsed, dried and re-weighed. The percentage of grease removed was calculated, and the results are shown in Table 1.

TABLE 1

| Solvent | % Grease Removed |
|---|---|
| d-Limonene | 90.5 |
| Butyl Cellosolve | 25.13 |
| Edenor ME C1270 | 48.74 |
| Dupont DBE-1B | 61.87 |
| PuraSolv EHL | 69.53 |
| Dowenol DpNB | 67.64 |
| Exxsol D-110 | 69.21 |
| No VOC Solvent Blend | 94.39 |

EXAMPLE 2

In order to test different esters, three test solutions were formed using 60% Exxsol D-110, 30% Dowenol DpNB, and 10% ester solvent. The ester solvents were Edenor ME C1270, DuPont DBE-IB (isobutyldibasic ester) and PuraSolv EHL (ethylhexylactate). These are labeled No VOC Solvent Blend A, B, or C, respectively, in Table 2. Using the test set forth in Example 1, these were compared with d-limonene, butyl cellosolve, DuPont DBE-IB, and PuraSolv EHL. As shown in Table 2, each of these was comparable or exceeded the performance of d-limonene and all exceeded the performance of butyl cellosolve.

TABLE 2

| Solvent | % Grease Removed |
|---|---|
| d-Limonene | 90.25 |
| Butyl Cellosolve | 25.13 |
| Edenor ME C1270 | 48.74 |
| No VOC Solvent Blend A | 94.39 |
| Dupont DBE-1B | 61.87 |
| No VOC Solvent Blend B | 89.55 |
| PuraSolv EHL | 69.53 |
| No VOC Solvent Blend C | 95.82 |

EXAMPLE 3

In order to test the efficacy of potential combinations of two of the three components of the present invention, 50:50 by weight mixtures of Edenor and DpNB, Edenor and Exxsol D-110, and DpNB and Exxsol D-110 were formed. Each of these three blends were then tested for percent grease removal. The Edenor/DpNB blend removed 52.77%, the Edenor/Exxsol D-110 blend removed 60.1%, and the DpNB/Exxsol D-110 blend removed 67.89%. Accordingly, this establishes that two of the three components by themselves do not perform as effectively as the three-component blend.

Thus, the three-component blend of the present invention including the hydro treated light petroleum distillate, the glycol ether and the ester solvent out performs commonly used solvents including d-limonene and butyl cellosolve. Further, the composition of the present invention contains no volatile organic compounds, whereas both d-limonene and butyl cellosolve are characterized as volatile organic compounds.

This has been a description of the present invention along with the preferred method of practicing the present invention. However, the invention itself should only be defined by the appended claims.

What is claimed is:

1. A solvent blend having a vapor pressure less than 0.1 mm Hg at 20° C. comprising 30% to 60% by weight of a petroleum distillate having a vapor pressure of less than 0.1 mm Hg at 20° C.;

20% to 50% by weight of a glycol ether soluble in said petroleum distillate and having a vapor pressure of less than 0.1 mm Hg at 20° C.;

at least 10% by weight of a $C_1$–$C_4$ ester having a carbon chain length less than 18 and having a vapor pressure of less than 0.1 mm Hg at 20° C.

2. The solvent blend claimed in claim 1 wherein said petroleum distillate is a hydro treated light petroleum distillate.

3. The solvent blend claimed in claim 1 wherein glycol ether is selected from the group consisting of propylene glycol n-butyl ether, propylene glycol n-propyl ether, diethylene glycol monobutyl ether, ethylene glycol monobutyl ether, dipropylene glycol methyl ether, tripropylene glycol methyl ether, dipropylene glycol n-propyl ether, dipropylene glycol mono n-butyl ether, tripropylene glycol mono n-butyl ether, propylene glycolphenyl ether and propylene glycol n-butyl ether, and blends thereof.

4. The solvent blend claimed in claim 1 wherein said ester is a methyl ester.

5. The solvent blend claimed in claim 1 wherein said ester is a monobasic ester.

6. The solvent blend claimed in claim 1 wherein said ester has a carbon length of 12 or less.

* * * * *